US007819582B2

(12) United States Patent
Rosen

(10) Patent No.: US 7,819,582 B2
(45) Date of Patent: Oct. 26, 2010

(54) CONTAINER BLANK AND CONTAINER MADE THEREOF

(75) Inventor: Åke Rosen, Helsingborg (SE)

(73) Assignee: Eco Lean Research & Development A/S, Copenhagen (DK)

( * ) Notice: Subject to any disclaimer, the term of this patent is extended or adjusted under 35 U.S.C. 154(b) by 792 days.

(21) Appl. No.: 10/572,551

(22) PCT Filed: Sep. 29, 2004

(86) PCT No.: PCT/SE2004/001387

§ 371 (c)(1),
(2), (4) Date: Mar. 17, 2006

(87) PCT Pub. No.: WO2005/030597

PCT Pub. Date: Apr. 7, 2005

(65) Prior Publication Data

US 2007/0041669 A1 Feb. 22, 2007

(30) Foreign Application Priority Data

Oct. 2, 2003 (SE) ..... 0302630

(51) Int. Cl.
*B65D 33/10* (2006.01)
*B65D 33/00* (2006.01)
*B65D 30/00* (2006.01)

(52) U.S. Cl. ..... 383/7; 383/207; 383/37; 383/906; 383/907

(58) Field of Classification Search ..... 383/10, 383/907, 104, 122, 37, 7, 207, 209, 906; 426/86; 222/92, 106
See application file for complete search history.

(56) References Cited

U.S. PATENT DOCUMENTS

| | | | | | |
|---|---|---|---|---|---|
| 3,448,915 | A | * | 6/1969 | Schwarzkopf | 383/37 |
| 3,935,993 | A | * | 2/1976 | Doyen et al. | 383/94 |
| 4,216,639 | A | | 8/1980 | Gautier | |
| 4,361,235 | A | * | 11/1982 | Gautier | 206/527 |
| 4,377,192 | A | * | 3/1983 | Gautier | 383/7 |
| 4,603,433 | A | * | 7/1986 | Gautier et al. | 383/7 |
| 4,911,562 | A | * | 3/1990 | Mazzeschi | 383/16 |

(Continued)

FOREIGN PATENT DOCUMENTS

EP 0 524 487 A1 1/1993

(Continued)

*Primary Examiner*—Jes F Pascua
(74) *Attorney, Agent, or Firm*—Birch, Stewart, Kolasch & Birch, LLP

(57) ABSTRACT

The invention relates to a container blank (1) comprising a bottom-forming wall (3) and two opposite side walls (2), said walls (2, 3) being joined along boundary lines (9, 10, 13). The container blank is characterised in that intersections (A, B, C, D) between a front boundary line (9) and respectively a rear boundary line (10) and an upper portion (5) and a bottom portion (7) constitute corners of a parallelogram having an angle of inclination ((x) relative to the longitudinal axis (L) of the container blank (1). The front boundary angle which is acute towards the bottom portion (7). The front boundary line (9) and the intermediate boundary line (13) give the central portion (6) an essentially symmetrical shape along the longitudinal axis (L) of the container blank (1). The invention also relates to a container (21) which is produced by filling of such a container blank (1).

10 Claims, 3 Drawing Sheets

U.S. PATENT DOCUMENTS

| | | | | | |
|---|---|---|---|---|---|
| 5,725,309 | A | * | 3/1998 | Robinson | 383/7 |
| 5,843,540 | A | * | 12/1998 | Heydarpour et al. | 428/35.2 |
| 6,095,689 | A | * | 8/2000 | Bochet | 383/200 |
| 6,293,073 | B1 | | 9/2001 | Caudle | |
| 7,018,099 | B2 | * | 3/2006 | Caudle | 383/104 |
| D537,732 | S | * | 3/2007 | Rosen | D9/707 |
| 2002/0102032 | A1 | * | 8/2002 | Sturgis et al. | 383/10 |
| 2004/0248720 | A1 | * | 12/2004 | Rosen | 493/356 |

FOREIGN PATENT DOCUMENTS

| | | | | |
|---|---|---|---|---|
| FR | 2.171.001 | A | | 9/1973 |
| FR | 2529528 | A1 | * | 1/1984 |
| GB | 1 598 843 | A | | 9/1981 |
| JP | 09183442 | A | * | 7/1997 |
| JP | 10273153 | A | * | 10/1998 |
| JP | 11314644 | A | * | 11/1999 |
| JP | 2000190987 | A | * | 7/2000 |
| JP | 2004051111 | A | * | 2/2004 |
| JP | 2004359258 | A | * | 12/2004 |
| JP | 2004359259 | A | * | 12/2004 |
| JP | 2005008193 | A | * | 1/2005 |
| JP | 2005271943 | A | * | 10/2005 |
| WO | WO 99/41155 | | * | 8/1999 |
| WO | WO-99/41155 | A1 | | 8/1999 |
| WO | WO 02/26567 | | * | 4/2002 |
| WO | WO-02/26567 | A2 | | 4/2002 |

* cited by examiner

CONTAINER BLANK AND CONTAINER MADE THEREOF

FIELD OF THE INVENTION

The present invention relates to a container blank comprising a bottom-forming wall and two opposite side walls, said walls being joined along boundary lines to form an essentially flat container blank. The invention also relates to a container which is produced by filling of such a container blank.

BACKGROUND ART

A container blank and, above all, a container of the type stated by way of introduction are known from, for instance, WO 99/41155 which discloses a container of a collapsible type, comprising three wall portions, two of which form opposing side walls and a third forms a bottom wall. The walls consisting of a flexible plastic material are bendable and joined to each other to define a compartment the volume of which depends on the relative position of the walls. In its unfilled state, the container, and thus its container blank, is flat.

The simplest type of container blank has a rectilinear geometry. If a carrying means is to be arranged in such a rectilinear container blank, this occurs by a handle-forming corner or lateral portion of the container blank being defined by a connecting portion. This means that the compartment in a container made of the container blank will have an asymmetric geometry instead of a symmetric and thus well-balanced geometry. A filled container having such an asymmetric compartment has a certain tendency to tilt forwards in use since the centre of gravity is moved to a position in front of the centre axis of the container blank. The tendency towards tilting also means that the flexible container, which because of its collapsible construction has no rigidity, in some cases may tend to collapse, at its front edge, like a filled bag that is placed on its end. This is to be seen as wrinkling along the connecting portion especially at the front edge of the container. Such wrinkling may affect the appearance of the container. Moreover, in long-term careless handling of the container, for instance during bumpy transport, damage due to wear may sometimes arise on the container material.

The problems associated with the movement of the centre of gravity and the subsequent wrinkling will be complicated if the container blank, and the container made thereof, has an outer curvature, such as the one shown in the above-mentioned WO 99/41155. In fact curvatures, in particular if they are sharp, increase the tendency towards wrinkling. Moreover such curvatures imply that the amount of material waste arising in the manufacture of the container blank increases.

OBJECTS OF THE PRESENT INVENTION

The object of the present invention is to provide an alternative, improved container blank. The container blank is to provide a well-balanced container of a collapsible type with a reduced tendency towards tilting.

Another object of the invention is that the container blank should be able to comprise a handle portion to form an easy-to-grip handle.

An additional object is that the amount of material waste is to be reduced.

SUMMARY OF THE INVENTION

To achieve at least one of the above objects and also additional objects not stated, which, however, will be evident from the following description, the present invention relates to a container blank having the features defined in claim 1. Preferred embodiments will be evident from claims 2-9. Moreover the invention concerns according to claim 10 a container which is produced by filling of such a container blank.

In the further description of the invention, a number of terms will be used to describe the geometry of the container blank. The term boundary line relates to a part of the connecting portion. Front and rear boundary lines relate, throughout the text, to the outer contours of the container blank at the front and rear edges respectively, and more specifically down to an upper boundary line of the bottom portion which is arranged essentially at the same level as the fold of the W-folded bottom-forming wall. By rear edge is meant the side of the container blank at which the handle portion is arranged. The term bottom portion relates to the portion defined by the W-folded bottom-forming wall along the longitudinal axis of the flat container blank. By upper portion is meant the upper part of the container blank which essentially corresponds to the portion of a container which is arranged above the liquid level in a container made of the container blank and filled to at least 80% of the volume intended for the container.

More specifically, a container blank is provided, comprising a bottom-forming wall and two opposite side walls, said walls being joined along boundary lines to form an essentially flat container blank, the container blank having an upper portion, a bottom portion, a central portion defined by the upper portion and the bottom portion and also by a front boundary line and an intermediate boundary line, said portions being arranged along the longitudinal axis of the container blank, and a handle portion defined by the intermediate boundary line and a rear boundary line. The container blank is characterised in that the intersections between the front boundary line and respectively the rear boundary line and the upper portion and the bottom portion constitute corners of a parallelogram comprising an angle of inclination relative to the longitudinal axis of the container blank, in which parallelogram the front boundary line forms an angle which is acute towards the bottom portion, and the front boundary line and the intermediate line along the longitudinal axis of the container blank give the central portion an essentially symmetrical, frustoconical shape.

The parallelogram formed by the intersections and having an acute angle relative to the longitudinal axis in the manner stated, in combination with the essentially symmetrical frustoconical shape of the central portion, gives some very important properties.

By the central portion being formed with a symmetrical frustoconical shape where the front boundary line forms an angle which is acute towards the bottom portion, a compensating effect is achieved. As such a container blank is being filled with contents, the initially divergent front and intermediate boundary lines will strive to achieve a parallel relationship. This is a result of the walls of the container blank successively bulging as filling proceeds. On condition that said angle has been optimised, the initially symmetrical, frustoconical shape of the bottom portion will in a filled container essentially correspond to a straight cylinder. A container made of a container blank according to the invention will thus be very well balanced and have a minimised risk of tilting.

The angled parallelogram shape compensates for any tendency of a container made of the container blank to tilt forwards. A filled container may be said to hold a liquid column which is enclosed partly by the central portion, partly by the bottom portion. In the container blank according to the invention, the angle of inclination of the parallelogram can be adjusted so that the centre of gravity of the liquid column part enclosed by the central portion is not moved to a position on the opposite side of the longitudinal axis of the container blank. An optimally balanced filled container is obtained when the centre of gravity of the liquid column part enclosed by the central portion coincides with the liquid column part enclosed by the bottom portion. The angle of inclination as this occurs depends on the height of the container blank and the cross-sectional geometry that is made up in a filled container made of the container blank.

By the tendency towards tilting being reduced, also the tendency towards wrinkling along the edge of the container will be reduced. Thus, a container made of the container blank will be more aesthetically pleasing and the risk of damage due to wear will be reduced.

The frustoconical shape also results in the centre of gravity in a container made of the container blank being low, which means that the container will stand stable on a base.

The handle portion allows a large gripping surface which, for instance, can be provided with a suitable hole pattern for gripping the container, or for arranging a gas-filled handle-forming duct.

The front boundary line preferably has a concave curvature relative to the central portion. The concave curvature can be used to form a spout-like duct means in the upper portion. The concave curvature in cooperation with the frustoconical central portion results, as mentioned above, in the centre of gravity in a filled container being low.

It is also preferred for the front boundary line to have a curvature essentially complementary to the rear boundary line. As a result, two succeeding container blanks in a continuous web of container blanks can be arranged in such a manner that the rear boundary line of a first container blank adjoins the front boundary line of a second container blank succeeding the first. Thus, the amount of material waste can be made very low.

In another preferred embodiment, the handle portion comprises a handle-forming duct means intended for gas filling. Such a duct means makes a container made of the container blank very comfortable to grip since the gas-filled duct means serves as a three-dimensional comfortable grip. Furthermore it serves as a stiffening "backbone" in the final container, which counteracts any tendency towards wrinkling along the connecting portion of the container during careless handling or transport.

It is also preferred that the bottom portion and the central portion together define, in a container made of the container blank, a volume corresponding to at least 80% of the volume intended for the container.

It is desirable for the container blank to comprise a duct means intended for filling and having an extent towards the interior of the container blank, and for this duct means intended for filling to taper towards the interior of the container blank. The tapering geometry causes tight abutment against the filling means which is intended for use in filling of the container blank, which reduces the risk of air penetration, foaming and also spillage.

It is further preferred for the container blank to comprise a spout-like duct means and for this to have a closed end portion with a tear initiation. This end portion is wholly or partially delimited from the rest of the spout-like duct means by a zone weakened by thinning of material, the end portion being manually separable, by the weakened zone, from the rest of the spout-like duct means.

According to another aspect, the invention relates to a container produced by filling a container blank having the features as claimed in any one of claims 1-10.

DESCRIPTION OF DRAWINGS

The invention will now be described in more detail by way of example and with reference to the accompanying drawings, which illustrate a currently preferred embodiment.

TECHNICAL DESCRIPTION

Figure 1:
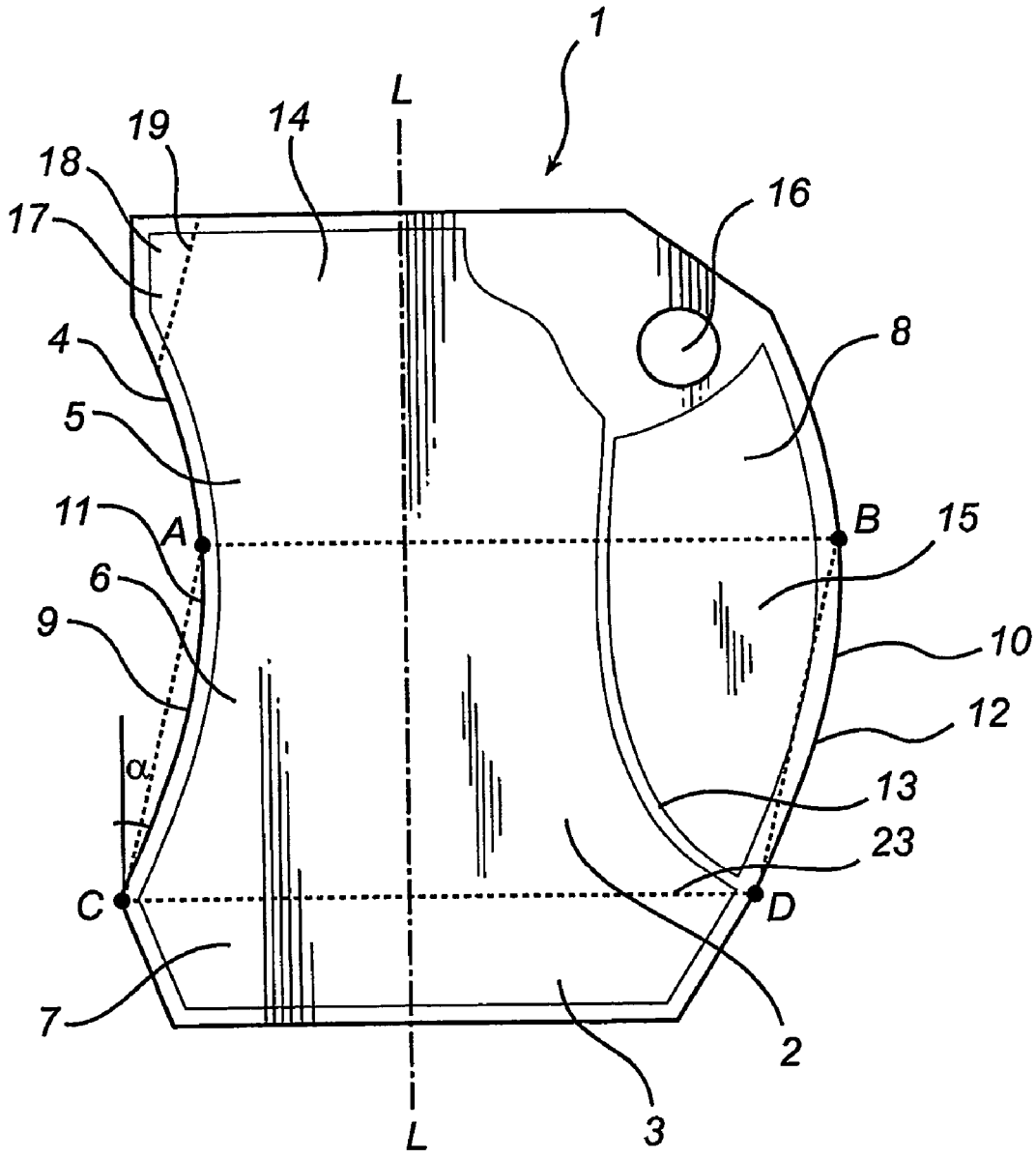
FIG. 1 illustrates a flat container blank according to the present invention.

With reference to FIG. 1, an embodiment of a container blank according to the invention is shown.

Figure 2:
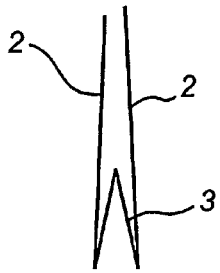
FIG. 2 is a schematic side view of the container blank.

The container blank 1 consists of two opposite side walls 2 and an intermediate bottom-forming wall 3 along the lower edge of the container blank 1. With reference to FIG. 2, the bottom-forming wall 3 can be arranged by folding a continuous web of material in the form of a W, the side walls 2 as well as the bottom-forming wall 3 being in one piece. Another alternative is to insert a bottom-forming wall folded in two between two opposite webs of material forming the side walls.

The material may consist of conventional flexible container materials of, for example, plastic. However, it is preferred for environmental reasons to use a container laminate containing a core layer with a mineral-based filler and a binder of polyolefin.

Figure 4:
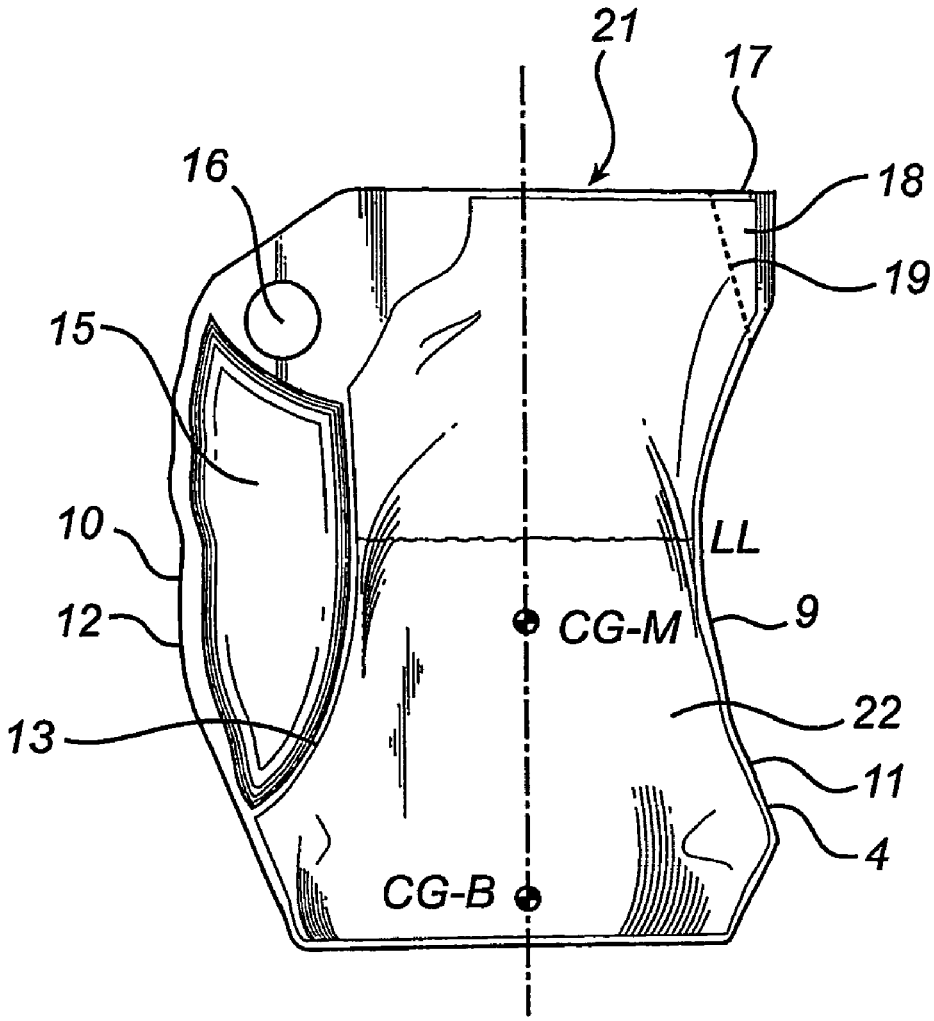
FIG. 4 shows a filled container made of a container blank according to FIG. 1.

The walls 2, 3 are joined along a peripheral continuous connecting portion 4 to form a closed container blank 1. It will be appreciated that the connecting portion 4 is not continuous along the entire periphery if the bottom-forming wall is arranged by being folded in the form of a W. The container blank 1 is adapted not to be opened until it is to be filled in order to produce a completed container 21, see FIG. 4. It should be observed that the container shown in FIG. 4 is very schematically drawn. The geometry, and in particular the shape of the central portion and the bottom portion, will, due to the collapsible construction, depend on the filling ratio. The term container 21 relates below to a filled container 21 produced by the container blank 1. The connecting portion 4 thus defines, together with the walls 2, 3, a compartment 22 in the container 21 whose volume depends on the relative position of the walls 2, 3 and, thus, on the filling ratio of the container. This means that the container is of a collapsible type. The connecting portion 4 is preferably formed by the walls 2, 3 included in the container blank being welded together. Also other methods are conceivable.

The connecting portion 4 can be divided into a number of parts which henceforth will be referred to as boundary lines and which will be described below.

Referring once more to FIG. 1, the container blank 1 is, for descriptive purposes, divided into an upper portion 5, a central portion 6, a bottom portion 7 and a handle portion 8. The upper portion 5 relates to the upper part of the container blank 1 which essentially corresponds to the portion of a container 21 which is arranged above the liquid level LL in a container 21 which is made of the container blank 1 and which is filled to at least 80% of the volume intended for the container, see FIG. 4. It will thus be appreciated that the upper portion 5, due to the flexible container material and the collapsible construction of the container, is not defined by the same line in the container blank as in the container. Moreover, the definition thereof depends on the geometry of the container blank. The boundary, shown in FIG. 1, between the upper portion and the central portion therefore is highly schematic. The bottom portion 7 corresponds to the portion in the flat container blank 1 which is defined by the bottom-forming wall 3. The central portion 6 corresponds to the portion which is defined by the upper portion 5, the bottom portion 7, a front boundary line 9 and an intermediate boundary line 13. The front boundary line 9 extends along the front edge 11 of the container blank 1. The rear boundary line 10 extends along the rear edge 12 of the container blank 1. Between the front 9 and rear boundary line 10 extends the intermediate boundary line 13 which together with the rear boundary line 10 defines the handle portion 8. The handle portion may thus constitute a portion of its own, but may also constitute part of the upper portion.

The intersections A, B, C, D between the front boundary line 9, the upper portion 5, the bottom portion 7 and, more specifically, an upper boundary line 23 which is arranged on essentially the same level as the fold of the bottom-forming wall folded in the form of a W, and the rear boundary line 10 are arranged so that they form corners of a geometry essentially in the form of a parallelogram which is indicated by dashed lines. The parallelogram has an angle of inclination $\alpha$ relative to the longitudinal axis L of the container blank 1. The angle of inclination $\alpha$ is arranged so that the front boundary line 9 forms an angle which is acute towards the bottom portion 7. The angle required depends on, among other things, the height of the container blank and the geometry of the cross-section along the longitudinal axis that is made up by the bottom-forming wall and the side walls, respectively. The angle of inclination $\alpha$ will be discussed below.

Figure 3:
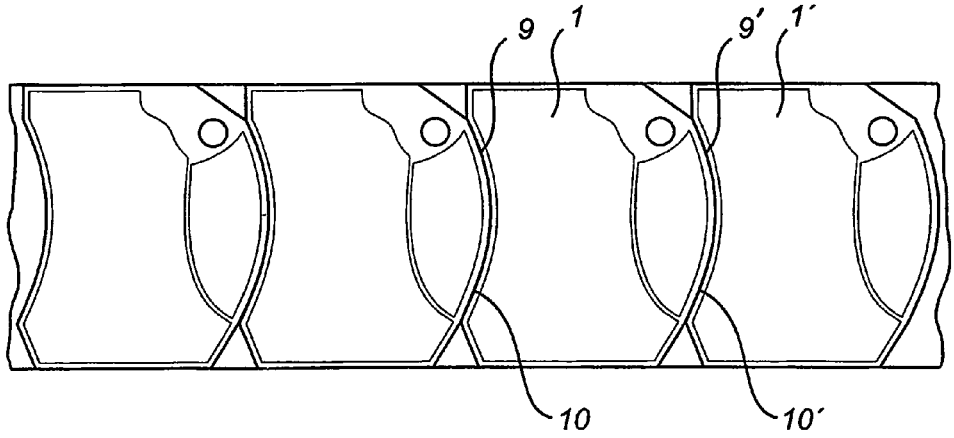
FIG. 3 shows part of a continuous web of container blanks.

With reference to FIGS. 1 and 3, the front boundary line 9 has a curvature essentially complementary to the rear boundary line 10 at least along the extent of the central portion 6. The reason for this is above all saving of material since two succeeding container blanks 1, 1' in a continuous web of container blanks 20 can be oriented in such a manner that the front boundary line 9 of a first container blank 1 directly adjoins the rear boundary line 10' of a subsequent second container blank 1'.

Referring once more to FIG. 1, the intermediate boundary line 13 has such an extent that, in cooperation with the front boundary line 9, it gives the central portion 6 an essentially symmetrical shape around the longitudinal axis L. Because of the above-mentioned curvature of the front 9 and intermediate 13 boundary line, the symmetrical central portion 6 has a frustoconical shape.

The intermediate boundary line 13 in cooperation with the rear boundary line 10 defines, by means of the parallelogram and the symmetrical central portion 6, a corner of the container blank 1 which forms the handle portion 8. This surface is easy to grip independently of its shape. The handle portion 8 can be provided with, for example, a hole pattern (not shown) for the user's fingers or part of his hand. The container can thus easily be gripped like a jug. The handle portion 1 can also be provided with a duct means 15 which is adapted to be filled with air or some other gas in connection with filling of the container blank 1 with its contents to form a completed container. Such a gas-filled duct means 15 forms a very comfortable three-dimensional handle. It also serves as a stiffening "backbone" in the container which on the one hand provides stability and, on the other hand, counteracts any tendency towards wrinkling.

If the handle portion 8 is provided with such a duct means 15, it is advantageous if the handle portion 8 in its upper part is also provided with a hole 16. The hole 16 is in the first place intended to serve as a lifting lug if the containers, for instance when delivered to a shop, are placed close to each other in a transport unit in such a manner that the handles are not easy to reach. In this position, an individual container can easily be gripped by slipping a finger into the lifting lug so that the container can be lifted.

As mentioned above, the front boundary line 9 has a preferably concave curvature relative to the central portion 6. This concave curvature forms in cooperation with the upper portion 5 a spout-like duct means 17 in the container blank 1, through which duct means the completed container 21 is to be emptied by being handled in a pouring motion. The spout-like duct means 17 is closed in an end portion 18 by a part of the connecting portion 4. The spout-like duct means 17 is, like the rest of the container blank 1, made of a mineral-based filler material such as chalk or talc in combination with a binder of polyolefin material. When opening a completed container 21, an outer portion of the duct means 17 is cut or torn off, whereby the compartment 22 is made to communicate with the environment.

If the end portion 18 is adapted to be torn off, the end portion 18 is wholly or partially delimited from the rest of the spout-like duct means 17 by a zone 19 weakened by thinning of material. The weakened zone 19 has such a strength that the end portion 18 along the zone is manually separable from the rest of the spout-like duct means 17. The weakening can be obtained by subjecting the zone to heat or pressure, or a combination thereof. By being treated in this way, the preferred kind of material is made brittle so as to be tearable.

The container blank 1 comprises also in its upper portion 5 a duct means 14 intended for filling. As shown in FIG. 1, the duct means 14 extends into the container blank 1. This extent preferably tapers somewhat towards the interior of the container blank. The duct means 14 is closed by a part of the connecting portion 14. In connection with filling, the duct means is opened to be penetrated by a filling means (not shown), after which it is closed again. It should thus be noted that the container blank 1 is completely closed by the connecting portion until it is to be filled with its contents to form a container. A once sterile container blank thus need not be sterilised again in connection with the filling operation.

As mentioned above, the container blanks 1 are made of continuous webs of material to form a continuous web of container blanks 20, see FIG. 3. The container blanks 1 are arranged side by side in such a manner that the front boundary line 9 of a first container blank 1 directly adjoins the rear boundary line 10' of a second container blank 1 succeeding the first container blank. The front boundary line 9 should thus, as has been mentioned above, have the same curvature as the rear boundary line 10 at least along the extent of the central portion 6. As mentioned above, the connecting portion 4 is formed preferably by welding.

Before the thus formed continuous web of container blanks 20 is wound onto a roll for further delivery, excess material between two succeeding container blanks is punched out. Examples of excess material are material between the bottom portions 7, material between the upper portions 5 and material in the hole 16 which forms the lifting lug. The amount of material waste and the position thereof depend, of course, on the contour of the container blank. Punching preferably occurs by the continuous web of container blanks passing a reel punch.

FIG. 4 shows a filled container 21 which is made of a container blank 1 according to the above description.

The container 21 comprises a compartment 22 which is essentially defined by the connecting portion 4, i.e. the boundary lines 9, 10, 13 and the walls 2, 3 included in the container. The compartment 22 has a maximum volume that exceeds the volume for which the container 21 is intended. This is necessary since the container material is flexible and the container 21 is of a collapsible type. When opening the container 21, which occurs by a part of the spout-like duct means 17 being separated, it must be possible to grip the container 21 without at the same time being forced to squeeze the liquid column into the compartment, which would result in an uncontrolled liquid flow out through the spout-like duct means. The intended volume of the container 21 therefore corresponds essentially to that volume or liquid column in the compartment 22 which is defined by the bottom portion 7 and the central portion 6. As mentioned above, the bottom portion 7 and the central portion 6 should together define at least 80% of the intended volume of the container. The liquid level of this liquid column is schematically shown in FIG. 4 by the line LL.

The central portion 6 has, as mentioned above, an essentially symmetrical shape due to the front boundary line 9 and the intermediate boundary line 13. The symmetry means in an optimally balanced container 21 that the centre of gravity CG-M of the liquid column part enclosed by the central portion 6 essentially coincides with the centre of gravity CG-B of the liquid column part enclosed by the bottom portion 7. By the centres of gravity CG-M, CG-B coinciding along the longitudinal axis L, the tendency of the container 21 towards tilting is reduced. How well the two centres of gravity CG-M and CG-B coincide depends, among other things, on the angle of inclination α. The angle of inclination α is very difficult to indicate since it depends on factors, such as the height, width and material rigidity of the container 21. Another very important factor is the cross-sectional geometry of the compartment 22 which is made up by the walls 2, 3 included in the container 21. The choice of the angle of inclination α enables compensation for tilting effects.

By the tilting tendency being reduced, also the tendency towards wrinkling of the connecting portion along the front edge 11 of the container 21 is reduced. A gas-filled duct means 15 in the handle portion 8 additionally reduces the tendency towards wrinkling.

The present invention thus relates to a container blank 1 which is intended for a container 21 of a collapsible type whose volume depends on the relative position of the walls 2, 3 and, accordingly, the filling ratio of the container 21. The container blank 1 can be divided into an upper portion 5, a central portion 6, a bottom portion 7 and a handle portion 8. The central portion 6 is defined by a front 9 and an intermediate boundary line 10 while the handle portion 8 is defined by the intermediate boundary line 13 and a rear boundary line 10. The intersections A, B, C, D, in which the front 9 and the rear boundary line 10 intersect the upper portion 5 and the bottom portion 7, constitute corners of a parallelogram with an angle of inclination α relative to the longitudinal axis L of the container blank 1. Moreover the central portion 6 has, by the extent of the intermediate boundary line 13, a frustoconical shape which is symmetrical around the longitudinal axis L. For an optimally balanced container 21 made of such a container blank, it means that the centre of gravity CG-M of the liquid column part which is held in the central portion 6 in the longitudinal direction of the container 21 coincides with the centre of gravity CG-B of the liquid column part which is enclosed by the bottom portion 7. This results in a very well balanced container 21 where the tendency to tilt is reduced relative to prior-art containers due to the movement of the centres of gravity. The reduced tendency to tilt also decreases the tendency towards wrinkling along the front edge 11 of the container 21. By the front boundary line 9 at least along the central portion 6 having a curvature which is essentially complementary to the rear boundary line 10, a very advantageous positioning of container blanks is allowed along a continuous web of container blanks 20, which produces a very low amount of material waste. As a result, a container blank 1 and a container 21 made thereof according to the objects stated by way of introduction have been provided.

It will be appreciated that the present invention is not limited to the shown embodiment of the inventive container blank and a container made thereof. Several modifications and variants are thus possible and the invention is consequently exclusively defined by the appended claims.

The invention claimed is:

1. A container blank comprising:

a bottom-forming wall and two opposite side walls, said walls being joined along boundary lines to form an essentially flat container blank, the container blank having:

an upper portion, a bottom portion, a central portion defined by the upper portion and the bottom portion and also by a front boundary line and an intermediate boundary line, said portions being arranged along a longitudinal axis of the container blank, and a handle portion defined by the intermediate boundary line and a rear boundary line, wherein the intersections between the front boundary line and a first geometrical line coinciding with a transition between the upper portion and the central portion, the front boundary line and a second geometrical line coinciding with a transition between the bottom portion and the central portion, the rear boundary line and said first geometrical line, and the rear boundary line and said second geometrical line constitute corners of a parallelogram comprising an angle of inclination defined by a lateral side of said parallelogram and the longitudinal axis, said angle being acute towards the bottom portion, the front boundary line and the intermediate boundary line along the longitudinal axis of the container blank give the central portion an essentially symmetrical, frustoconical shape, the front boundary line has a concave curvature relative to the central portion, the concave curvature of the front boundary line has an end point at the intersection between the front boundary line and said second geometrical line, and the intermediate boundary line has a concave curvature relative to the central portion, the concave curvature of the intermediate boundary line has an end point at the intersection between the intermediate boundary line and said second geometrical line.

2. The container blank as claimed in claim 1, in which the front boundary line has a complementary curvature to the rear boundary line.

3. The container blank as claimed in claim 1, in which the handle portion comprises a handle-forming duct means intended for gas filling.

4. A container blank as claimed in claim 1, in which the bottom portion and the central portion together, in a container made of the container blank, define a volume corresponding to at least 80% of the volume intended for the container.

5. The container blank as claimed in claim 1, comprising a duct means intended for filling, said duct means having an extent towards the interior of the container blank.

6. The container blank as claimed in claim 5, in which the duct means intended for filling tapers towards the interior of the container blank.

7. The container blank as claimed in claim 1, comprising a spout-like duct means.

8. The container blank as claimed in claim 7, in which the spout-like duct means has an end portion with a tear initiation.

9. The container blank as claimed in claim 8, in which the end portion is wholly or partially delimited from the rest of the spout-like duct means by a zone weakened by thinning of material, the end portion being manually separable, by the weakened zone, from the rest of the spout-like duct means.

10. A container produced by filling of a container blank as claimed in any one of claim 1 or 2-9.

* * * * *